US005407261A

United States Patent [19]

Mercer

[11] Patent Number: 5,407,261

[45] Date of Patent: Apr. 18, 1995

[54] RETRACTABLE STORAGE CONTAINER

[76] Inventor: Glenn E. Mercer, 449 18th Ave., Indian Rocks Beach, Fla. 34635

[21] Appl. No.: 118,603

[22] Filed: Sep. 10, 1993

[51] Int. Cl.[6] ..... A47F 5/08

[52] U.S. Cl. ..... 312/248; 312/245

[58] Field of Search ..... 312/245, 246, 247, 248

[56] References Cited

U.S. PATENT DOCUMENTS 3,331,645 1/1966 Vercellotti .
3,485,545 12/1969 Beckerman .
3,846,005 11/1974 Harper et al. ..... 312/248
4,026,434 4/1977 Howard ..... 312/247
4,275,942 6/1981 Steidl ..... 312/247
4,446,660 4/1984 Miller et al. .
5,329,865 7/1994 McWard ..... 312/242

*Primary Examiner*—Kenneth J. Dorner
*Assistant Examiner*—Gerald A. Anderson
*Attorney, Agent, or Firm*—Harold D. Shall

[57] ABSTRACT

A storage container for attachment to the enclosed ceiling of a room. The container has an upper and lower portion with the portions being hinged together. An over-center linkage including a tension spring, connects the upper and lower portions and a pivot pin in the linkages engages a portion of the linkage to act as a physical stop to inhibit movement thereof.

1 Claim, 2 Drawing Sheets

RETRACTABLE STORAGE CONTAINER

BACKGROUND OF THE INVENTION

This invention relates to storage containers generally and more particularly to storage containers for attachment to the ceiling of a room where the joists are above the enclosed ceiling.

It used to be the custom to build homes with a substantial amount of storage space, however, as the costs of homes has increased, the amount of storage space has been substantially reduced. As shown in U.S. Pat. Nos. 3,331,645 and 4,446,660, one method of increasing storage was to incorporate storage containers in the space between the joists of the ceiling where the joists were not covered. While this is in some homes readily available space, in most homes today, even in the garage the ceiling joists are enclosed by a covering ceiling to prevent rodents or other pests from infiltrating the house through this entrance. The space between the joists is, therefore, not readily available. Furthermore, even if it is available it is of a very limited depth. It is, therefore, an object of this invention to provide a storage space for attachment to the lower surface of an enclosed ceiling. Other and further objects of this invention will become apparent from a reading of the remainder of this specification and the appended claims.

SUMMARY OF THE INVENTION

An open topped box-like structure is adapted for securement to the lower surface of an enclosed ceiling. The box-like structure has an upper portion, which is secured to the ceiling, and a lower portion which is hinged to the upper portion at one end thereof, with the upper portion being deeper than the lower portion. A spring loaded linkage arrangement connects the lower portion to the upper portion and is operative to hold them securely together. However, the linkage is such that upon the lower portion being pulled down, the linkage goes over-center and the spring then holds the lower portion down. When the lower portion is down, items like garden tools and golf bags can be placed in the lower portion which can then be raised to the upper portion where once again the spring will hold the two portions together.

DETAILED DESCRIPTION OF THE INVENTION

Figure 1:
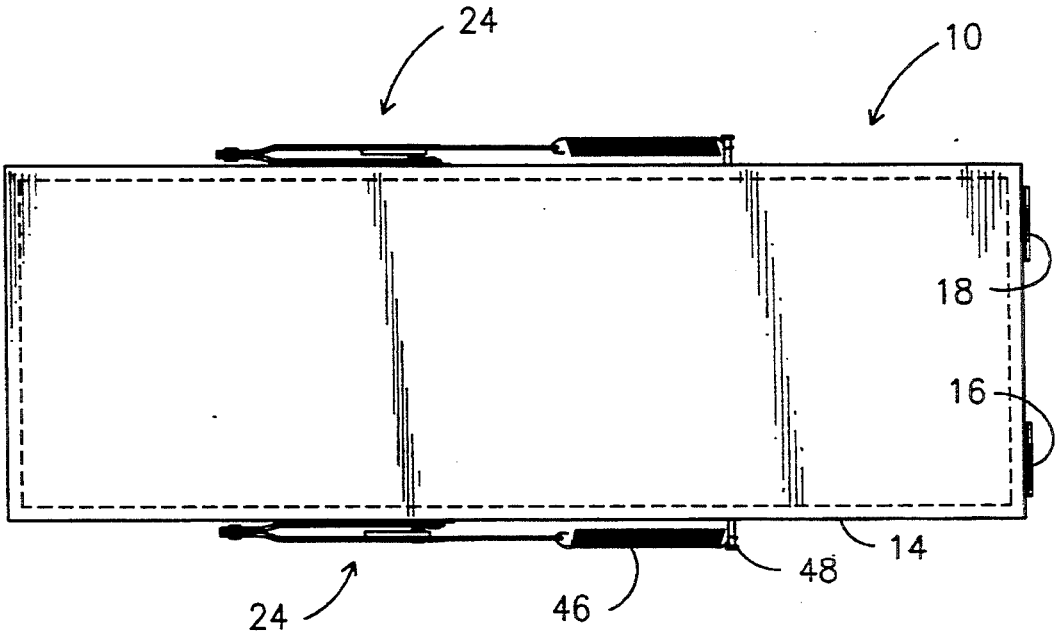
FIG. 1 is a plan view of this invention not mounted on a ceiling.
Figure 2:
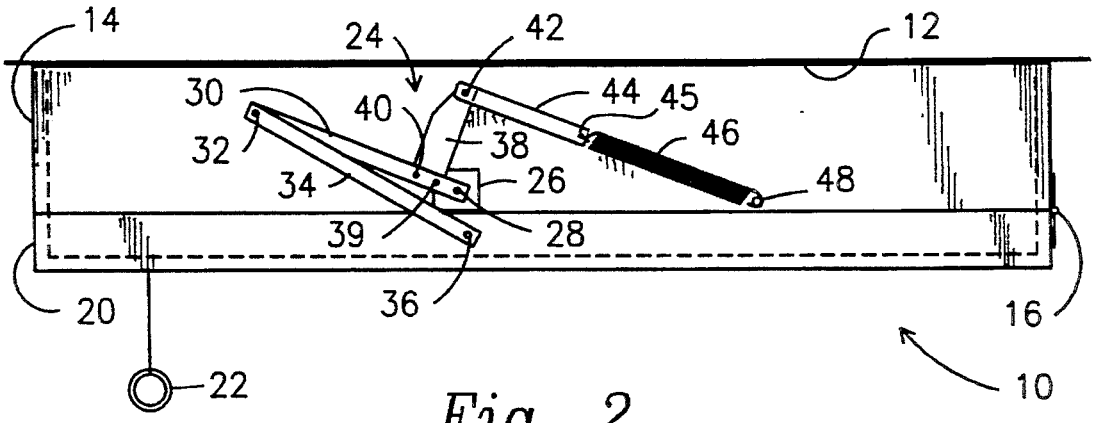
FIG. 2 is a side view of this invention mounted on a ceiling, with only a fragment of the ceiling being shown.
Figure 3:
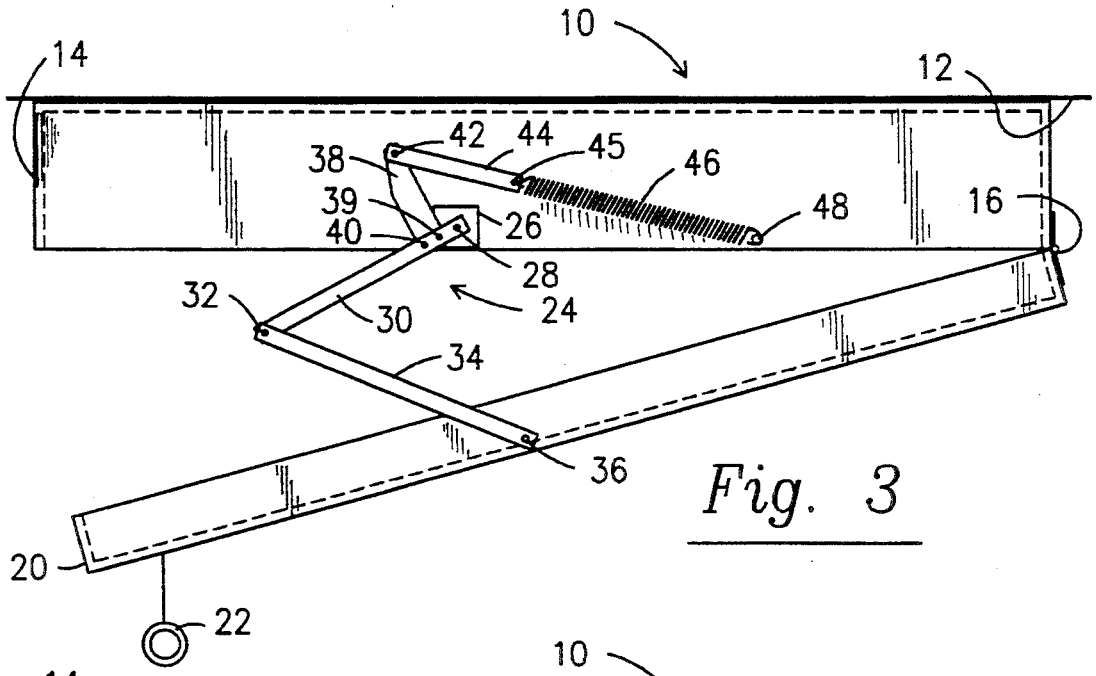
FIG. 3 is a view like FIG. 2 with the lower portion being partially lowered.
Figure 4:
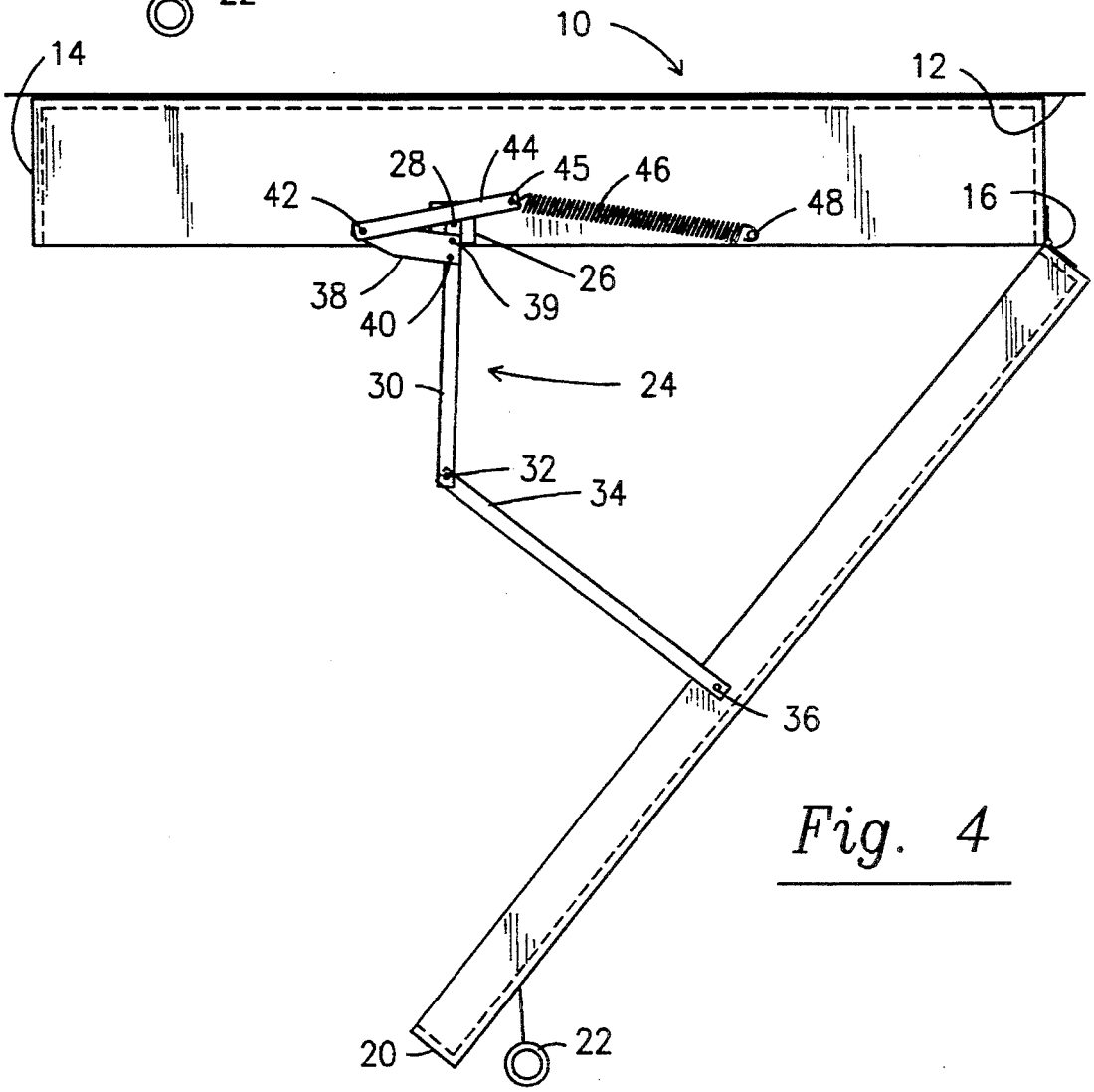
FIG. 4 is a view like FIG. 3 with the lower portion in its lowest position.

As seen in the drawings, the invention includes an open topped box-like structure 10 which, as seen in FIGS. 2–4, is secured to the lower surface of a ceiling, shown fragmentarily at 12 by a plurality of fasteners (not shown) the box-like portion 10 consists of an upper portion 14 having hinged thereto, by a pair of hinges 16 and 18, a lower portion 20, with the lower portion 20 having less vertical depth than the upper portion 14. The hinges 16 and 18 are at the right end of the box-like structure 10, as seen in the drawings, and the left end of the lower portion 20 has a puller 22 attached to the lower surface thereon, which puller may be grasped to pull the lower portion 20 down ultimately to the position shown in FIG. 4.

Linkage means 24 are connected between the upper and lower portions 14 and 20 and are operable to hold the lower portion in its upper position of FIG. 2, assist the person pulling on the puller 22 to move the lower portion to its position shown in FIG. 4, to maintain the lower portion in its lower position of FIG. 4 and to assist the person utilizing the structure 10 to move the lower portion back to its upper position of FIG. 2.

Referring to the linkage means 24 as seen in FIGS. 2–4, since the upper and lower portions 14 and 20 are preferably made of wood, a metal mounting plate 26 is secured to the upper portion 14 at the lower edge thereof and slightly to the left of the longitudinal midpoint thereof. Pivotally secured to the plate 26 by a pivot pin 28 is the right end of a first link 30, which link as seen in FIG. 2 extends to the left and upwardly from the pin 28 and as seen in FIG. 4 extends downwardly from the pin 28. At the left end of the first link 30, a rivet 32 pivotally connects the first link 30 to the left end of a second link 34, which second link as seen in FIG. 2–4 extends to the right and downwardly from the rivet 32. At its right end, the second link 34 is pivotally secured by a pivot pin 36 to the lower portion 20 at a location to the left of the longitudinal midpoint thereof.

A lever arm 38 is fixedly secured to the first link 30 adjacent the right end thereof by a pair of rivets 39 and 40 and, as seen in FIG. 2, extends perpendicularly from the link 30. The upper end, as seen in FIG. 2, of the arm 38 is pivotally connected by a pivot pin 42 to the left end of a second arm 44, while the right end of the second arm 44 has an opening 45 therein which receives the left end of a coiled tension spring 46. The right end of the tension spring 46 is secured by a pin 48 to the upper portion 14.

As the linkage means 24 moves from its portion of FIG. 2 to its position in FIG. 4, the linkage means 24 goes over-center so that in the positions of FIGS. 2, and 3, the spring 46 is attempting to move the lower portion 20 to a closed relationship with the upper portion 14, while in the position of FIG. 4, the spring 46 allows the lower portion to remain in its open position. The pivot pin 28 is dimensioned so as to project outwardly from the plate 26 sufficiently so that when the linkage moves to the position shown in FIG. 4, the pin 28 will engage the lower side of the second arm 44 thereby to act as a physical stop or brake to prevent further downward movement of the lower portion from that shown. Without the physical stop, the lower portion could continue downwardly until the linkage 30, 34 become aligned and locked, requiring the operator to grab the links and break the alignment. There is even the potential for the linkage 30, 34, to pivot in the reverse direction and thereby distort the entire operation of the linkage.

Although the above description relates to a presently preferred embodiment, changes may be made therein without departing from the spirit of the invention as defined in the following claims.

What is claimed is:

1. A storage container for attachment to an enclosed ceiling comprising in combination, a) a box-like structure adapted to be secured to a ceiling, b) said box-like structure including an upper portion and a lower portion with said lower portion having an enclosed bottom and being shorter in a vertical direction then said upper portion, c) hinge means connecting said lower portion to said upper portion, d) linkage means connecting said lower portion to said upper portion, said linkage means holding said upper and lower portions in a closed relationship when said box-like structure is closed and allowing said upper and lower portions to remain in an open relationship when said box-like structure is open, e) said linkage means including pivot pin means, and f) said pivot pin means engaging a part of said linkage to prevent further movement thereof in open direction at such time as said portions are in a desired open relationship, said linkage means includes a first and a second link pivotally connected to each other, said first link being pivotally connected to said upper portion by said pivot pin means and said second link being pivotally connected to said lower portion, a first lever arm is securedly connected to said first link in a perpendicular relationship, a second lever arm is pivotally connected to said first lever arm, tension spring means connects said second lever arm to said upper portion, and said pivot pin means engages said second lever arm to inhibit further movement thereof in an open direction.

* * * * *